US011375836B2

(12) United States Patent
Lopez

(10) Patent No.: US 11,375,836 B2
(45) Date of Patent: Jul. 5, 2022

(54) DEVICE FOR SOCK PLACEMENT OVER AND REMOVAL FROM A FOOT OF A USER

(71) Applicant: Vive Health LLC, Naples, FL (US)

(72) Inventor: Juan Lopez, Naples, FL (US)

(73) Assignee: Vive Health LLC, Naples, FL (US)

( * ) Notice: Subject to any disclaimer, the term of this patent is extended or adjusted under 35 U.S.C. 154(b) by 0 days.

(21) Appl. No.: 17/073,079

(22) Filed: Oct. 16, 2020

(65) Prior Publication Data

US 2022/0117425 A1 Apr. 21, 2022

(51) Int. Cl.
*A47G 25/80* (2006.01)
*A47G 25/90* (2006.01)

(52) U.S. Cl.
CPC ..... *A47G 25/80* (2013.01); *A47G 25/90* (2013.01); *A47G 25/905* (2013.01); *A47G 25/908* (2013.01)

(58) Field of Classification Search
CPC ..... A47G 25/905; A47G 25/80; A47G 25/90; A47G 25/908
See application file for complete search history.

(56) References Cited

U.S. PATENT DOCUMENTS 4,789,087 A * 12/1988 Doorenbos ..... A47G 25/905 223/111
5,626,269 A 5/1997 Duarte
5,894,970 A 4/1999 Belkin
6,932,252 B2 8/2005 Simmons
7,070,074 B2 * 7/2006 Landsberger ..... A47G 25/905 223/111
7,234,616 B2 6/2007 Thom
7,287,675 B1 * 10/2007 Sullivan ..... A47G 25/82 223/111
7,395,951 B2 7/2008 Clayman
8,356,735 B1 * 1/2013 Drakeford ..... A47G 25/908 223/112
2006/0138181 A1 6/2006 Thom
2011/0042425 A1 * 2/2011 Norris ..... A47G 25/905 223/112

(Continued)

FOREIGN PATENT DOCUMENTS

AU 2003100774 11/2003
WO WO2018202249 11/2018

OTHER PUBLICATIONS

U.S. Appl. No. 29/755,113, filed Oct. 16, 2020, Vive Health LLC.
U.S. Appl. No. 17/073,079, filed Nov. 12, 2021, Office Action.

*Primary Examiner* — Ismael Izaguirre
(74) *Attorney, Agent, or Firm* — Workman Nydegger

(57) ABSTRACT

A multi-functional device comprises a device body defined by a first wall that includes a first inner face and a first outer face, a second wall that includes a second inner face and a second outer face, and a third wall that includes a third inner face and a third outer face. The second wall is connected to and extends from the first wall at a first interface on a first lateral side of the first wall. The third wall is connected to and extends from the first wall at a second interface on a second lateral side of the first wall. The multi-functional device comprises a hook arranged on the device body configured to facilitate removal of a sock from a foot of a user, and a plurality of ridges arranged on the device body configured to facilitate placement of a sock over a foot of a user.

21 Claims, 7 Drawing Sheets

(56) References Cited

U.S. PATENT DOCUMENTS

| | | | | |
|---|---|---|---|---|
| 2014/0263486 | A1* | 9/2014 | Taylor | A47G 25/908<br>223/111 |
| 2015/0313396 | A1* | 11/2015 | Carlson | A47G 25/908<br>2/239 |
| 2019/0254458 | A1* | 8/2019 | Shahar | A47G 25/90 |

* cited by examiner

DEVICE FOR SOCK PLACEMENT OVER AND REMOVAL FROM A FOOT OF A USER

BACKGROUND

Many individuals find difficulty in placing socks over their feet and/or removing socks from their feet. For example, geriatrics, disabled persons, and/or others may experience difficulty or inability in reaching their hands toward their feet, even from a seated position, to facilitate placement of socks over their feet and/or to facilitate removal of socks from their feet.

For at least the foregoing reasons, there is an ongoing need and desire for improved sock placement over and removal from a foot of a user.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY

Implementations of the present disclosure extend to devices for facilitating both placement of a sock over a foot of a user and removal of a sock from a foot of a user.

Some embodiments include a multi-functional device that comprises a device body defined by a first wall that includes a first inner face and a first outer face, a second wall that includes a second inner face and a second outer face, and a third wall that includes a third inner face and a third outer face. The second wall is connected to and extends from the first wall at a first interface on a first lateral side of the first wall. Similarly, the third wall is connected to and extends from the first wall at a second interface on a second lateral side of the first wall. The first wall, the second wall, and the third wall at least partially extend between a first end of the device body and a second end of the device body.

The multi-functional device also comprises a hook arranged on the device body. The hook is configured to facilitate removal of a sock from a foot of a user. The multi-functional device also comprises a plurality of ridges arranged on the device body. The plurality of ridges is configured to: (1) when a sock is arranged over the device body, provide frictional force between at least a portion of the sock and the device body to facilitate placement of the sock over a foot of a user, and (2) provide a grip holdable by a user to facilitate removal of a sock from a foot of a user.

Some embodiments include a multi-functional device that comprises a device body defined by a first wall that includes a first inner face and a first outer face, a second wall that includes a second inner face and a second outer face, and a third wall that includes a third inner face and a third outer face. The second wall is connected to and extends from the first wall at a first interface on a first lateral side of the first wall, and the third wall is connected to and extends from the first wall at a second interface on a second lateral side of the first wall. The first wall, the second wall, and the third wall at least partially extend between a first end of the device body and a second end of the device body. The first end of the device body is configured to retain a sock to facilitate placement of the sock over a foot of a user. The multi-functional device also comprises a hook arranged on the second end of the device body. The hook is configured to facilitate removal of a sock from a foot of a user.

Some embodiments include a multi-functional device that comprises a device body defined by a first wall that has a first inner face and a first outer face, a second wall that has a second inner face and a second outer face, and a third wall that has a third inner face and a third outer face. The second wall is connected to and extends from the first wall at a first interface on a first lateral side of the first wall, and the third wall is connected to and extends from the first wall at a second interface on a second lateral side of the first wall. The first wall, the second wall, and the third wall at least partially extend between a first end of the device body and a second end of the device body. A second outer edge of the second wall and a third outer edge of the third wall form corresponding grooves configured to retain a sock to facilitate placement of the sock over a foot of a user. The multi-functional device also comprises a hook arranged on the second end of the device body. The hook is configured to facilitate removal of a sock from a foot of a user.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Additional features and advantages will be set forth in the description which follows, and in part will be obvious from the description, or may be learned by the practice of the teachings herein. Features and advantages of the invention may be realized and obtained by means of the instruments and combinations particularly pointed out in the appended claims. Features of the present invention will become more fully apparent from the following description and appended claims or may be learned by the practice of the invention as set forth hereinafter.

BRIEF DESCRIPTION OF THE DRAWINGS

In order to describe the manner in which the above-recited and other advantages and features can be obtained, a more particular description of the subject matter briefly described above will be rendered by reference to specific embodiments which are illustrated in the appended drawings. Understanding that these drawings depict only typical embodiments and are not therefore to be considered to be limiting in scope, embodiments will be described and explained with additional specificity and detail through the use of the accompanying drawings.

DETAILED DESCRIPTION

Figure 1:
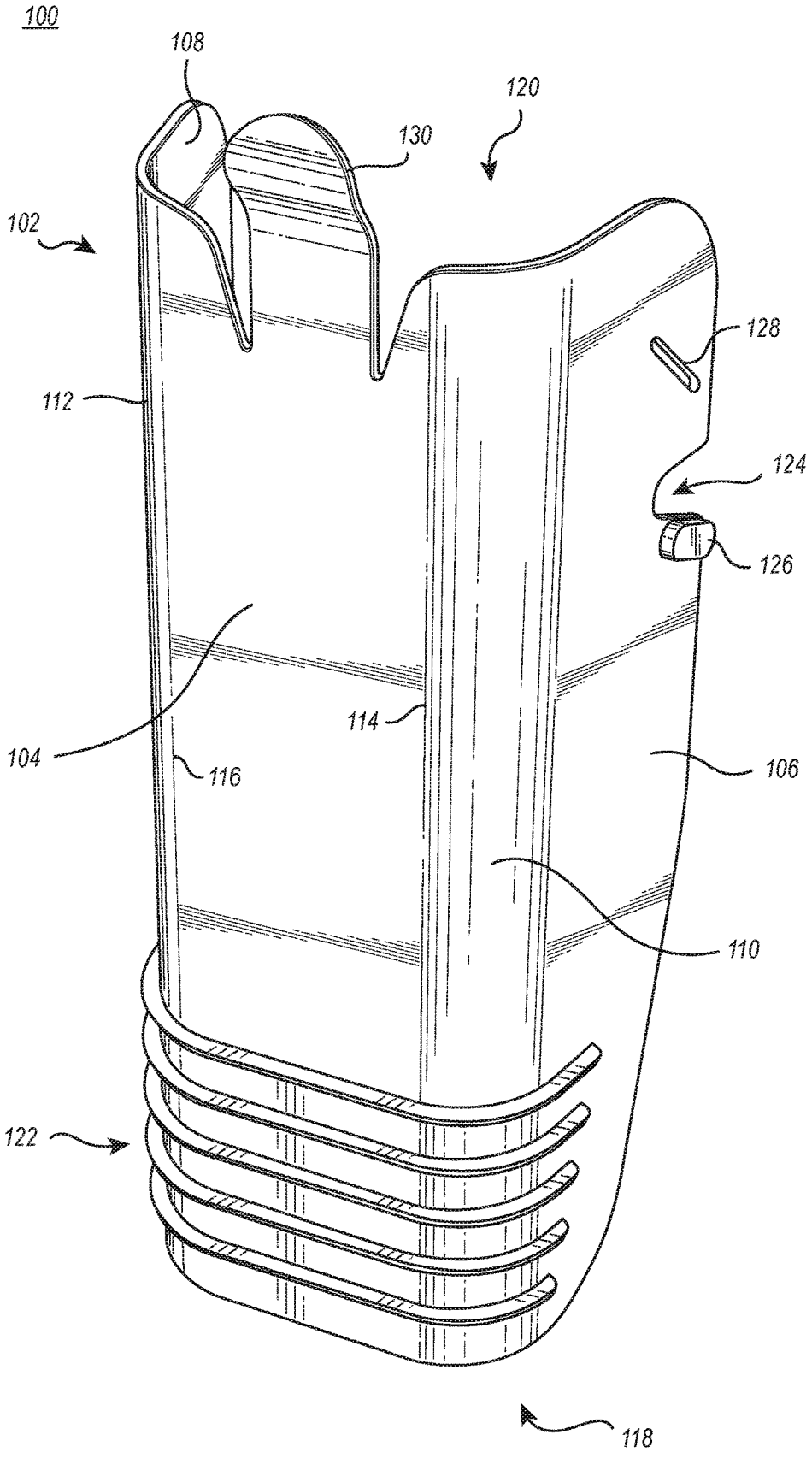
FIG. 1 illustrates a bottom perspective view of a device for sock placement and removal.

Implementations of the present disclosure extend to devices for sock placement over and removal from a foot of a user.

In some implementations, a multi-functional device comprises a device body defined by a first wall that includes a first inner face and a first outer face, a second wall that includes a second inner face and a second outer face, and a third wall that includes a third inner face and a third outer face. The second wall is connected to and extends from the first wall at a first interface on a first lateral side of the first wall. Similarly, the third wall is connected to and extends from the first wall at a second interface on a second lateral side of the first wall. The first wall, the second wall, and the third wall at least partially extend between a first end of the device body and a second end of the device body.

The multi-functional device also comprises a hook arranged on the device body. The hook is configured to facilitate removal of a sock from a foot of a user. The multi-functional device also comprises a plurality of ridges arranged on the device body. The plurality of ridges is configured to: (1) when a sock is arranged over the device body, provide frictional force between at least a portion of the sock and the device body to facilitate placement of the sock over a foot of a user, and (2) provide a grip holdable by a user to facilitate removal of a sock from a foot of a user.

Those skilled in the art will recognize, in view of the present disclosure, that at least some of the disclosed embodiments may be implemented to address various shortcomings associated with conventional devices for assisting users in placing socks over feet and/or devices for assisting users in removing socks from feet.

For example, conventional techniques for assisting users in placing and removing socks include one device for assisting users in placing socks over user feet and a separate device for assisting users in removing socks from user feet. In contrast, at least some implementations of the present disclosure provide a multi-functional device that is configured for facilitating both placement of a sock over a foot of a user and removal of a sock from a foot of a user. Thus, implementations of the present disclosure may allow users to at least partially avoid problems associated with utilizing different devices for sock placement and removal, such as device misplacement, travel bulk, etc.

At least some implementations of the present disclosure also provide features that improve sock placement and/or removal functionality, as compared with conventional devices. For instance, many conventional devices are configured to receive a sock and allow users to advance the device over or around their foot to dispose the sock over the user's foot. However, many users find difficulty in placing a sock over a conventional device for facilitating sock placement over user feet. At least some implementations of the present disclosure provide a tapered device body that enables the device to easily receive a sock in preparation for placement over a foot of a user.

Furthermore, many conventional devices fail to facilitate a desired distribution of a sock over a user's foot. For example, many conventional devices may fail to adequately retain a sock placed thereon as the device is advanced over or around the user's foot and/or leg. This may cause the sock to become rapidly released from the conventional device and disposed over the user's foot and/or leg in a manner that results in loose positioning of the sock over the user's foot and/or failure of the sock to reach a desired height on the user's leg.

Thus, at least some implementations of the present disclosure include ridges that provide frictional force between the device and a sock placed thereon, which may allow the device to release the sock over the user's foot and/or leg in a controlled manner that facilitates a desirable distribution of the sock over the foot of the user and/or allows the sock to reach a desired height on the user's leg. The ridges may also provide additional benefits, such as providing a grip for users to hold onto when controlling a hook of the device to facilitate sock removal.

Further, at least some implementations of the present disclosure include one or more grooves and/or protrusions positioned on the device body that allow the device to retain the sock during advancement over the foot and/or leg of the user, releasing the sock from the device in a controlled manner as the sock achieves a desired distribution and/or height over the foot and/or leg of the user.

Having described some of the various high-level features and benefits of the disclosed embodiments, attention will now be directed to FIGS. 1 through 6. These Figures illustrate various supporting illustrations related to the disclosed embodiments.

FIG. 1 illustrates a bottom perspective view of a device 100 configured to facilitate both placement of a sock over a foot of a user and removal of a sock from a foot of a user. In this regard, the device 100 may be regarded as a multi-functional device. As illustrated in FIG. 1, in some instances, the device 100 is at least partially formed by a device body 102, which includes a first wall 104, a second wall 106, and a third wall 108. In some instances, the first wall 104 may be regarded as a base or bottom wall of the device 100, and the second wall 106 and the third wall 108 may be regarded as extending vertically or away from the first wall 104 such that the first wall 104 is nonparallel to the second wall 106 and the third wall 108.

FIG. 1 illustrates that, in some implementations, the first wall 104 connects to the second wall 106 via an interface 110, and the first wall connects to the third wall 108 via an interface 112. For example, the first wall 104 of the device 100 of FIG. 1 connects to the interface 110 at a first lateral side 114 of the first wall 104, and the second wall 106 extends from the interface 110. Similarly, the first wall 104 connects to the interface 112 at a second lateral side 116 of the first wall 104, and the third wall 108 extends from the interface 112.

FIG. 1 illustrates the first wall 104, the second wall 106, the third wall 108, the first interface 110, and the second interface extending at least partially between a first end 118 of the device body 102 and a second end 120 of the device body 120. For example, the first interface 110 and the second interface 112 that join the various walls mentioned above extend from the first end 118 to the second end 120.

Figure 2:
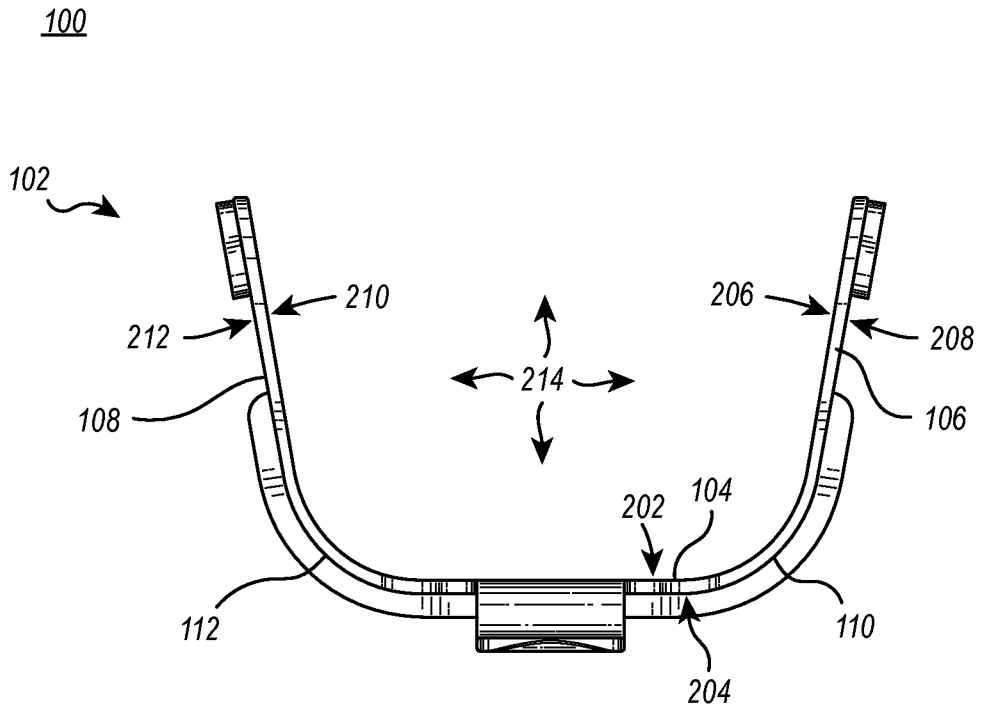
FIG. 2 illustrates a rear plan view of the device for sock placement and removal.

FIG. 2 illustrates a rear view of the device 100 and shows that, in some instances, the device body 102 forms a substantially U-shaped body. For example, FIG. 2 illustrates an implementation in which the first interface 110 forms a curved wall that provides an arcuate or curved transition between the first wall 104 and the second wall 106. Similarly, FIG. 2 illustrates that the second interface 112 may form a curved wall that provides a corresponding arcuate or curved transition between the first wall 104 and the third wall 108. FIG. 2 also demonstrates that the first wall 104 includes a first inner face 202 and a first outer face 204. Similarly, the second wall includes a second inner face 206 and a second outer face 208, and the third wall includes a third inner face 210 and a third outer face 212.

As is depicted in the example shown in FIGS. 1 and 2, the device body 102 of the device 100 includes various components/structures that allow the device 100 to facilitate both sock placement over and sock removal from a foot of a user. For instance, to facilitate sock placement over a foot of a user, the first end 118 of the device 100 may be configured to receive a sock such that the sock becomes positioned around the device body 102. In some instances, the device 100 at least partially retains the sock on the device body 102 for controlled sock placement via a plurality of ridges 122, grooves 124, and/or protrusions 126. FIGS. 1 and 2 show an example in which the plurality of ridges 122 is arranged near or proximate to the first end 118 of the device body 102 (e.g., within one inch or within a few inches). The example also depicts the grooves 124 formed by outer edges of the second wall 106 and the third wall 108 of the device body 102 (see FIG. 3 also). Additionally, the example also depicts the protrusions 126 extending outward from the second wall 106 and the third wall 108.

By way of example, a user may advance an opening of a sock over the first end 118 of the device 100 and cause the sock to engage with the various elements disposed on the device body 102, such as the plurality of ridges 122, the grooves 124, and/or the protrusions 126. For instance, the user may draw the sock over the plurality of ridges 122 and position upper portions of the sock (e.g., sock material surrounding the upper opening of the sock) around the protrusions 126 and within the grooves 124. When the sock is so positioned about the device body 102, the device body 102 may provide a space 214 for receiving a foot of a user into the opening of the sock positioned around the device body 102 (see FIG. 2).

A device 100 may receive a foot of a user (e.g., through the space 214) in various ways. For example, in some instances, the device body 102 includes slots 128 (see FIGS. 1 and 3) configured to receive a strap (see FIG. 7) that a user may pull to advance the device 100 over their foot, causing their foot to enter the space 214 into the opening of a sock positioned around the device body 102 (e.g., causing the foot to advance in a direction from the second end 120 toward the first end 118 relative to the device body 102). In other instances, the device 100 with a sock positioned thereabout becomes secured to a floor or other permanent structure, and the user advances their foot relative to the secured device 100 through the space 214 and into the opening of the sock (e.g., still causing the foot to advance in a direction from the second end 120 toward the first end 118 relative to the device body 102).

Regardless of how the device 100 with a sock positioned thereabout receives a user's foot, the various structures of the device 100 (e.g., the plurality of ridges 122, the grooves 124, the protrusions 126) may facilitate controlled release of the sock over the user's foot. For example, the plurality of ridges 122, the grooves 124, and/or the protrusions 126 may engage with various portions of the sock positioned about the device body 102 in a manner that provides frictional forces between the various portions of the device body 102 and the various portions of the sock. The frictional forces may cause the portions of the device 100 to at least partially retain the sock positioned about the device 100 as a user's foot advances through the opening of the sock until forces between the user's foot and the sock overcome the frictional forces between the sock and the device 100.

In some instances, the various frictional forces between a sock and the various structures of the device 100 (e.g., the plurality of ridges 122, the grooves 124, the protrusions 126) are sufficiently high such that the forces between the sock and the foot of a user necessary to overcome them are typically only achieved as portions of the sock becomes stretched over the foot of the user during advancement through the space 214 of the device 100. Accordingly, in some implementations, the various structures of the device 100 of the present disclosure may facilitate a desirable distribution of a sock over a user's foot. In contrast, conventional devices may fail to provide sufficient frictional force such that forces between the sock and the foot of a user easily overcome conventional frictional forces before the sock becomes stretched over the foot of the user, which may result in an uncomfortable or undesirable fitting of the sock over the foot of the user.

It should be noted that although the foregoing example focuses, in at least some respects, on implementations in which the sock disposed over the device body 102 engages with the plurality of ridges 122, the grooves 124, and the protrusion 126, at least some of the benefits described hereinabove may be realized in implementations where the sock engages with fewer than all, or none, of the components of the device body 102 described hereinabove for facilitating placement of the sock over a foot of a user.

For example, in some implementations, a sock is long enough to engage with the plurality of ridges 122 but is not long enough to engage with the grooves 124 and/or the protrusions 126. Furthermore, in some instances, a sock is long enough to engage with the plurality of ridges 122 and the grooves 124 and/or the protrusions 126, but the user refrains from positioning the sock over one or more of these elements (e.g., because fewer than all of the components may provide sufficient frictional force to facilitate desirable placement of the sock over a foot of a user). Thus, in some instances, a user may position a sock around the device body 102 in engagement with the plurality of ridges 122 and refrain from placing the sock in engagement with the grooves 124 and/or the protrusions 126. A user may then proceed to advance their foot relative to the device 100 (e.g., through space 214) to dispose the sock over their foot, with the ridges providing sufficient frictional force between the device 100 and the sock to facilitate desirable positioning of the sock over the foot. Accordingly, a user may selectively customize use of the device 100 to accommodate different socks and/or situations.

Figure 3:
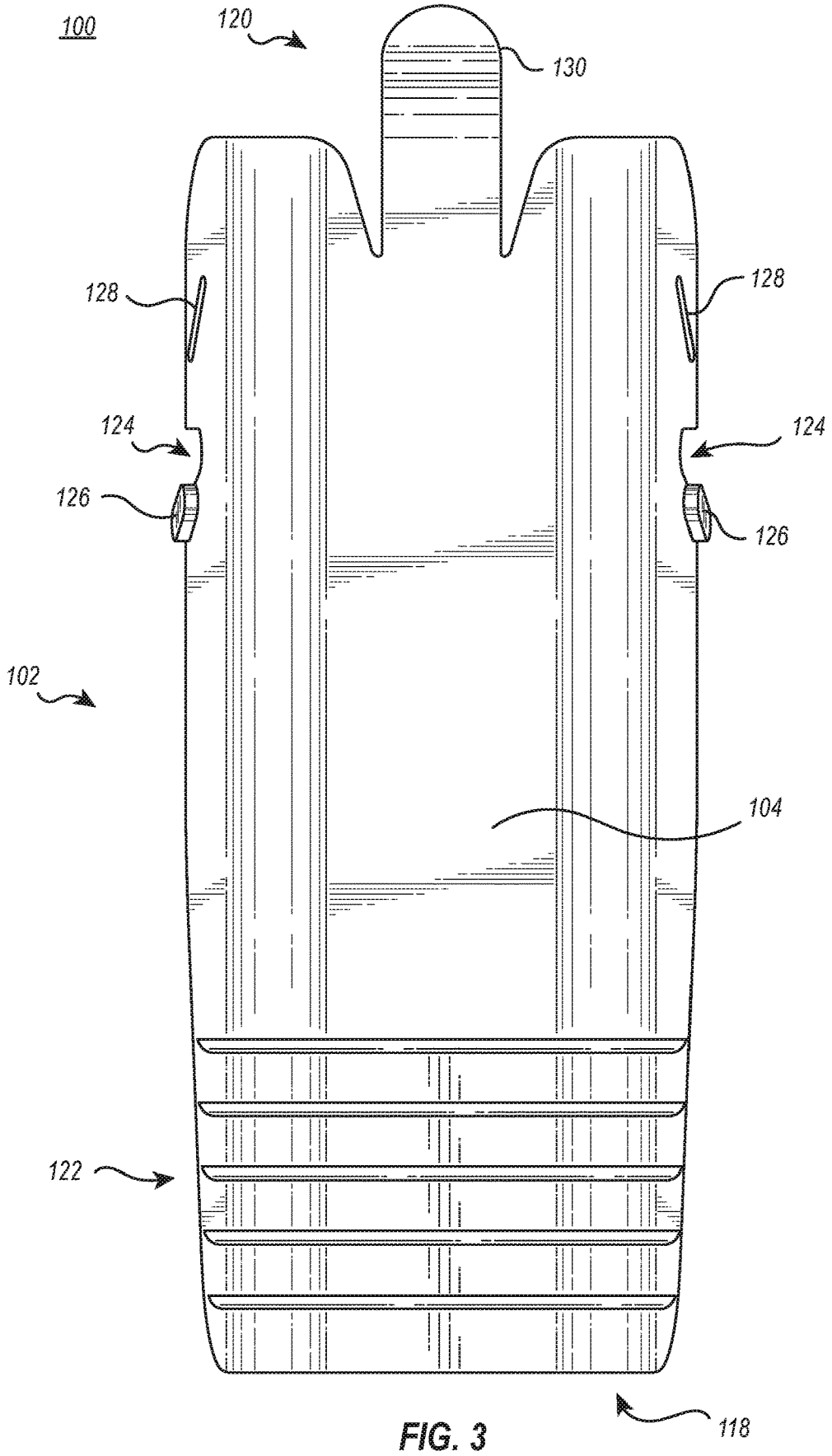
FIG. 3 illustrates a bottom elevation view of the device for sock placement and removal.

As shown in FIGS. 1, 2, and 3, the device body 102 of the device 100 includes a hook 130, which is configured to facilitate removal of a sock from a foot of a user. FIGS. 1 and 3 illustrate an example in which the hook 130 is arranged on the second end 120 of the device body 102. By way of example, to remove a sock from a foot of a user, a user may position the device 100 such that the first outer face 204 of the first wall 104 of the device body 102 is directed toward a leg of the user, with the second end 120 of the device body 102 oriented toward an opening of the sock. The user may then insert the hook 130 into the opening of the sock between the sock material and the leg of the user, with at least a portion of the device body 102 remaining outside of the sock opening to allow the device 100 to maintain engagement with the sock. With the hook 130 so positioned, the user may advance the device 100 along the leg of the user, thereby causing the device 100 engaged with the sock to apply a force on the sock that at least partially pulls the sock off of the leg of the user.

In some instances, in addition to the functionality described hereinabove related to placing a sock over a foot of a user, the plurality of ridges 122 may also advantageously provide additional functionality for facilitating removal of a sock from a foot of a user. For example, the plurality of ridges 122 may provide a grip holdable by a user for manipulating the device 100 to facilitate removal of a sock from a foot of a user as described hereinabove.

Thus, in at least some instances, a single device 100 may facilitate both placing of socks over feet of users and removal of socks from feet of users, thus avoiding problems that may arise from utilizing different devices for sock placement and sock removal.

Additional details concerning example configurations for the various components of a device 100 according to the present disclosure will now be provided. FIG. 3 illustrates a bottom view of the device 100. FIG. 3 illustrates that, in some instances, the plurality of ridges 122 is arranged proximate to the first end 118 of the device body 102. However, in some implementations, the plurality of ridges 122 is positioned centrally on the device body 102 or in another configuration relative to the device body 102.

FIG. 3 also illustrates that, in some implementations, the plurality of ridges 122 includes five ridges. However, those skilled in the art will recognize, in view of the present disclosure, that a device 100 may comprise any number of one or more ridges in accordance with implementations of the present disclosure. Furthermore, FIG. 3 demonstrates that, in at least some instances, the plurality of ridges 122 comprises a linear arrangement of equally spaced parallel protrusions positioned on the first outer face 204 of the first wall 104. Other configurations for the plurality of ridges 122 are also within the scope of this disclosure, such as any arrangement of protrusions (i.e., ridges) at any spacing that form any combination of linear, curved, zigzag, and/or shaped structures.

Furthermore, FIG. 3 illustrates that, in some instances, the plurality of ridges 122 and the hook 130 are arranged on the device body 102 opposite to one another (e.g., on the first end 118 and the second end 120 of the device body 102, respectively). It will be appreciated, however, that this arrangement is provided as a non-limiting example. In other examples, the hook 130 is arranged on the same end as the plurality of ridges 122, or the hook 130 is arranged on a lateral side of the device body that is not opposite to the first end 118 (e.g., extending from the second wall 106 or the third wall 108).

Figure 4:
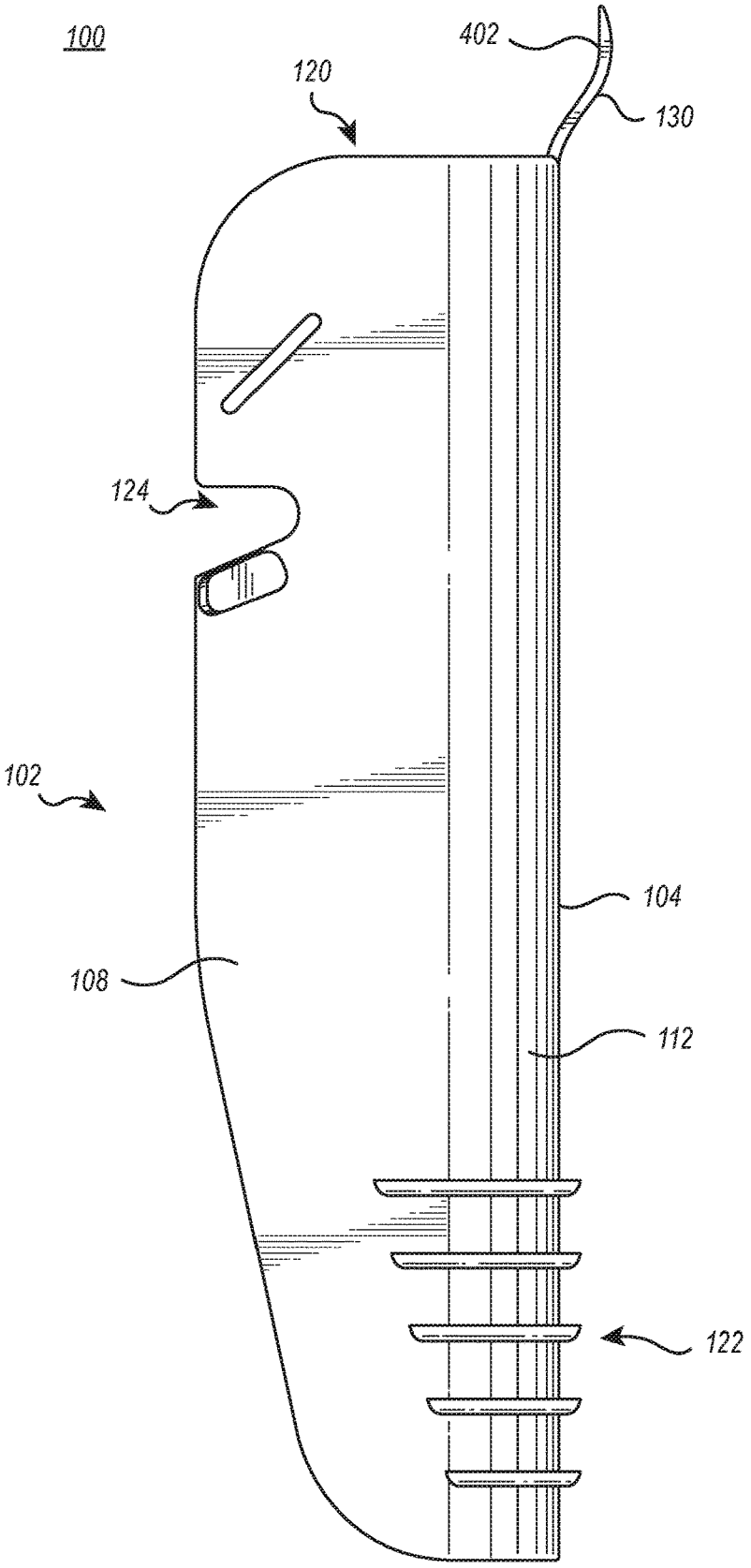
FIG. 4 illustrates right elevation view of the device for sock placement and removal.

FIG. 3 illustrates an example in which at least some ridges of the plurality of ridges 122 extend over the first wall 104 of the device body 102. FIG. 4 illustrates right side view of the device 100. FIG. 4 furthermore illustrates that, in some implementations, at least some ridges of the plurality of ridges 122 further extend at least partially over the interface 112 and/or the third wall 108. While FIG. 4 illustrates the portion of the plurality of ridges 122 on the third wall 108 with the same shape, orientation, and spacing as the plurality of ridges on the first wall 104, it should be understood that in some embodiments the plurality of ridges 122 on the third wall 108 may employ a different shape, orientation, or spacing than the plurality of ridges on the first wall 104. Further, in some instances, by symmetry, at least some of the ridges of the plurality of ridges 122 may also extend at least partially over the interface 110 and/or the second wall 106. Again, the plurality of ridges 122 on the second wall 106 may employ a different shape, orientation, or spacing than the plurality of ridges on the first wall 104. Those skilled in the art will recognize that various aspects of the ridges of the plurality of ridges 122 (e.g., the number, height, length, and/or shape of the ridges) may be varied in different implementations to provide different frictional forces between a device 100 and a sock disposed thereon.

FIG. 4 also illustrates that, in some instances, the hook 130 is arranged on and/or extends from the second end 120 of the device body 102. In some implementations, the hook 130 comprises a hook end 402 that is arranged planarly offset from the first wall 104 of the device body 102 of the device 100. In some instances, providing a hook 130 that comprises a hook end 402 that is planarly offset from the first wall 104 of the device body 102 facilitates easy insertion of the hook 130 into an opening of a sock that is positioned around a foot and/or leg of a user.

Figure 5:
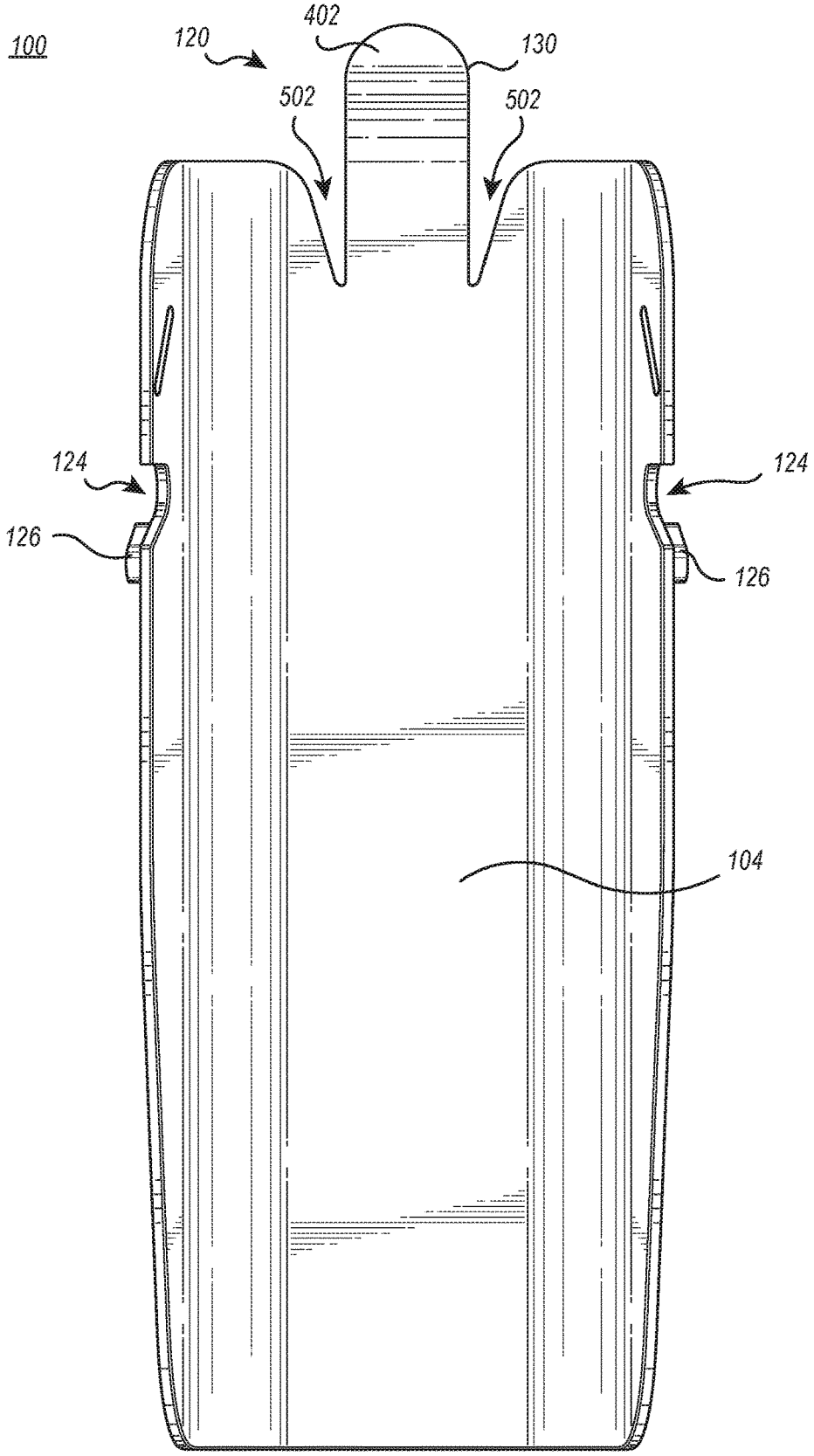
FIG. 5 illustrates a top elevation view of the device for sock placement and removal.

FIG. 4 furthermore illustrates that the hook 130 comprises a curved profile. In some instances, providing a hook 130 that includes a curved profile as shown in FIG. 4 allows the hook 130 to direct the cuff of a sock into engagement with other portions of the device body 102 to facilitate removal of a sock from a foot of a user. For example, FIG. 5 illustrates a top view of the device 100. FIG. 5 illustrates that, in some implementations, at least a portion of an edge of the first wall 104 of the device body (e.g., an edge of the first wall 104 at the second end 120 of the device body 102) forms depressions 502 on opposing lateral sides of the hook 130. The depressions 502 may be configured to receive and retain a portion of a sock that surrounds an opening of a sock (e.g., a cuff of a sock).

For example, to facilitate removal of a sock from a foot of a user, a user may insert a hook end 402 into an opening of the sock between the cuff of the sock and the leg of the user, as described hereinabove with reference to FIGS. 1, 2, and 3. After initial insertion of the hook end 402 into the sock opening, a user may continue to advance the hook end 402 through the opening of the sock, causing the cuff of the sock to advance along the hook 130 toward the device body 102. The cuff of the sock may reach the depressions 502 illustrated in FIG. 5 and become retained therein as the user continues to advance the device 100 to facilitate removal of the sock from the foot of the user. The depressions 502 may therefore aid the device 100 in maintaining engagement with the sock to allow the device 100 to apply force to the sock to facilitate removal of the sock from the foot of the user. Thus, the depressions 502 may enable the device 100 to facilitate easy removal of the sock from the foot of the user.

In addition, FIG. 5 illustrates corresponding grooves 124 formed by an outer edge of the third wall 108 of the device body 102 and by an outer edge of the second wall 106 of the device body 102. As indicated above, the grooves 124 may be configured to retain respective portions of a sock for facilitating placement of the sock over a foot of a user, as described hereinabove. FIG. 5 also illustrates corresponding protrusions 126 extending from the second outer face 208 of the second wall 106 of the device body 102 and the third outer face 212 of the third wall 108 of the device body. Similar to the grooves 124 mentioned above, the protrusions may be configured to retain respective portions of a sock for facilitating placement of the sock over a foot of a user, as described hereinabove.

Figure 6:
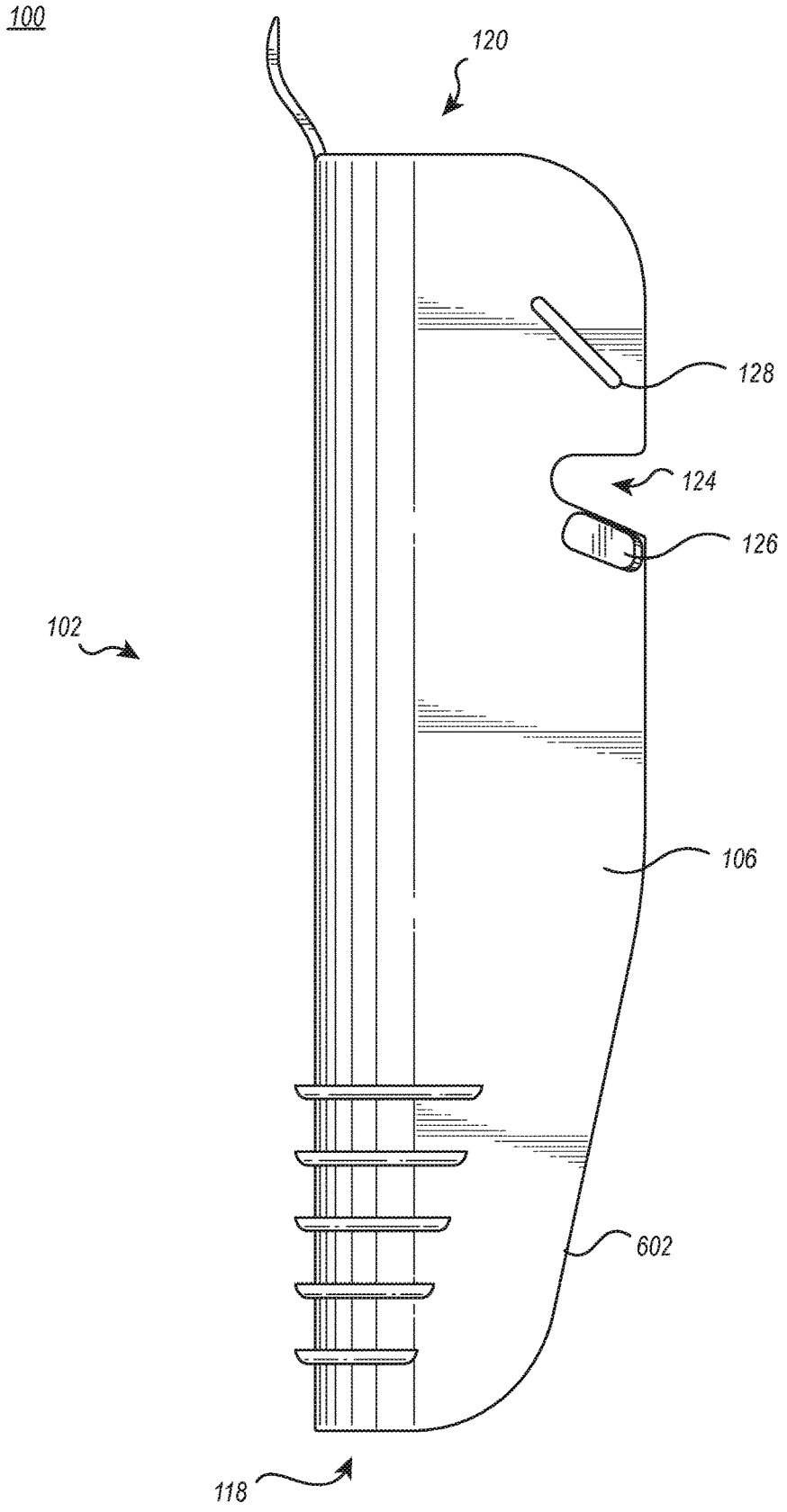
FIG. 6 illustrates a left side view of the device for sock placement and removal.

FIG. 6 illustrates a left side view of the device 100 for sock placement and removal. FIG. 6 shows that, in some implementations, the grooves 124 comprise substantially U-shaped grooves. In some instances, as shown in FIG. 6, the grooves 124 may include non-parallel sidewalls. For example, the groove 124 of FIG. 6 formed by the outer edge of the second wall 106 of the device body 102 includes a first sidewall arranged toward the first end 118 of the device body 102 and a second sidewall arranged toward the second end 120 of the device body 102. FIG. 6 illustrates an implementation in which the first sidewall arranged toward the first end 118 is non-parallel to the second sidewall and is slanted toward the first end 118. In some instances, providing a sidewall of the grooves 124 that is slanted toward the first end 118 enables a sock disposed about the device body 102 and within the grooves 124 to be released from the grooves 124 as the forces between a foot of a user and the sock increase during placement of the sock onto the foot of the user, as described hereinabove.

FIG. 6 also illustrates a protrusion 126 extending from the second wall 106 of the device body 102 and arranged adjacent to the groove 124 formed by the outer edge of the second wall 106. In particular, FIG. 6 illustrates the protrusion 126 arranged adjacent to the first sidewall of the groove 124 described above (i.e., a sidewall of the groove 124 that is arranged toward the first end 118 of the device body 102). In some instances, by symmetry, a corresponding protrusion 126 extending from the third wall 108 of the device body 102 may be arranged adjacent to a groove formed by the outer edge of the third wall 108. In some implementations, arranging the protrusions 126 adjacent to the grooves 124 enables the protrusions 126 to complement the grooves 124 in providing frictional force to retain portions of a sock disposed about the device body 102 during placement of the sock over a foot of a user.

FIG. 6 furthermore illustrates, that in some instances, the second wall 106 forms a taper 602 proximate to the first end 118 of the device body 102. In some instances, by symmetry, the third wall 108 forms a corresponding taper 602 proximate to the first end 118 of the device body 102. Stated differently, the second wall 106 and the third wall 108 may, in some implementations, taper toward the first end 118. In some instances, providing a device body 102 that forms a taper 602 toward the first end 118 of the device body 102 may facilitate easy placement of a sock over the device body 102 in preparation for placing the sock over a foot of a user, according to the present disclosure.

Figure 7:
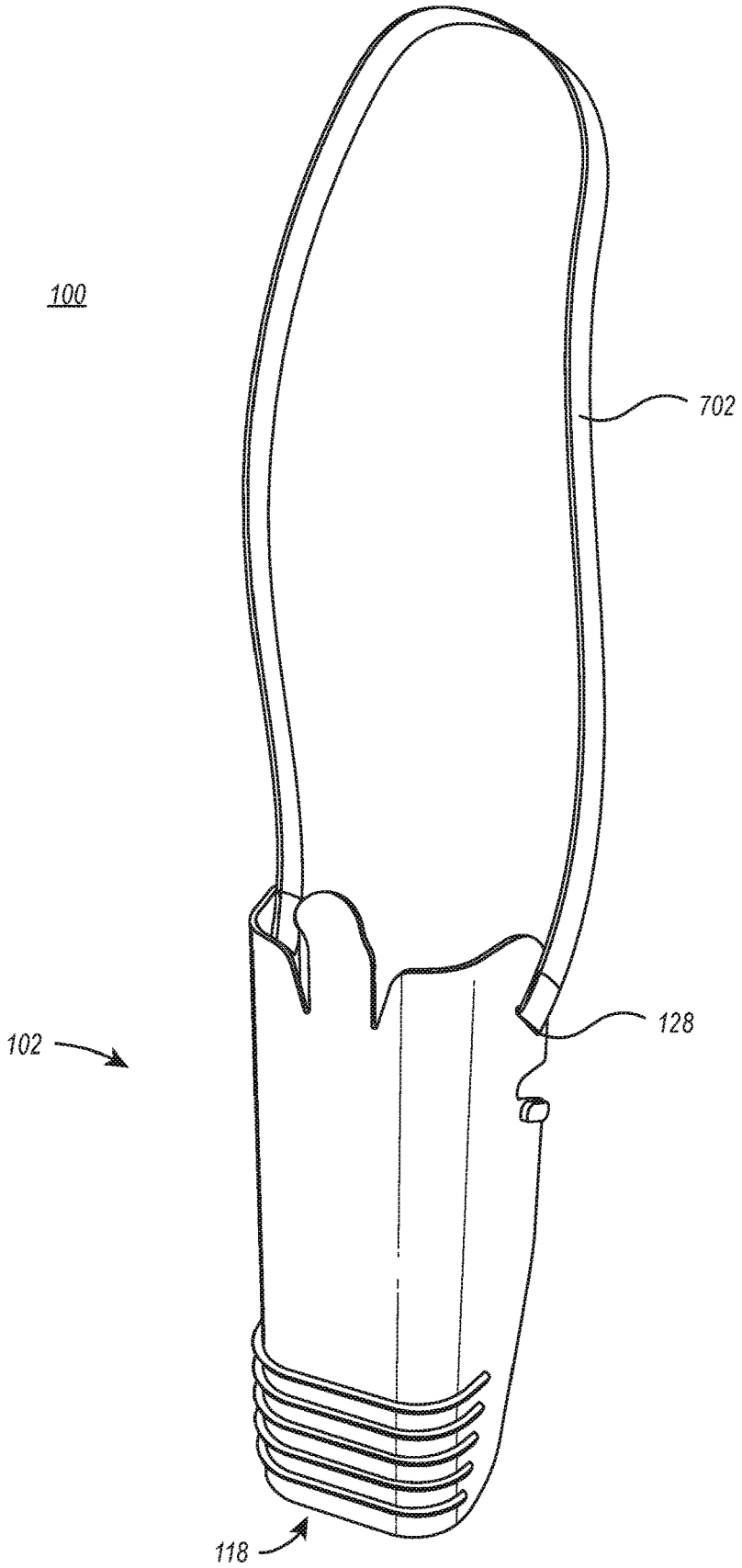
FIG. 7 illustrates a bottom perspective view of the device for sock placement and removal with a strap attached thereto.

FIG. 6 also provides an additional view of the slots 128 that are configured to receive respective portions of a strap (see FIG. 7) for facilitating placement of a sock over a foot of a user. FIG. 7 provides a view of the device 100 with a strap 702 inserted through the slots 128 and affixed to the device body 102. For example, after positioning a sock around a first end 118 of a device body 102, a user may use the strap 702 affixed to the slots 128 to pull the device 100 toward a foot of the user to advance the foot through the space 214 formed by the device 100 to place the sock over the foot of the user.

Various alterations and/or modifications of the inventive features illustrated herein, and additional applications of the principles illustrated herein, which would occur to one skilled in the relevant art and having possession of this disclosure, can be made to the illustrated embodiments without departing from the spirit and scope of the invention as defined by the claims, and are to be considered within the scope of this disclosure. Thus, while various aspects and embodiments have been disclosed herein, other aspects and embodiments are contemplated. While a number of methods and components similar or equivalent to those described herein can be used to practice embodiments of the present disclosure, only certain components and methods are described herein.

It will also be appreciated that systems, devices, products, kits, methods, and/or processes, according to certain embodiments of the present disclosure may include, incorporate, or otherwise comprise properties, features (e.g., components, members, elements, parts, and/or portions) described in other embodiments disclosed and/or described herein. Accordingly, the various features of certain embodiments can be compatible with, combined with, included in, and/or incorporated into other embodiments of the present disclosure. Thus, disclosure of certain features relative to a specific embodiment of the present disclosure should not be construed as limiting application or inclusion of said features to the specific embodiment. Rather, it will be appreciated that other embodiments can also include said features, members, elements, parts, and/or portions without necessarily departing from the scope of the present disclosure.

Moreover, unless a feature is described as requiring another feature in combination therewith, any feature herein may be combined with any other feature of a same or different embodiment disclosed herein. Furthermore, various well-known aspects of illustrative systems, methods, apparatus, and the like are not described herein in particular detail in order to avoid obscuring aspects of the example embodiments. Such aspects are, however, also contemplated herein.

The present disclosure may be embodied in other specific forms without departing from its spirit or essential characteristics. The described embodiments are to be considered in all respects only as illustrative and not restrictive. The scope of the invention is, therefore, indicated by the appended claims rather than by the foregoing description. While certain embodiments and details have been included herein and in the attached disclosure for purposes of illustrating embodiments of the present disclosure, it will be apparent to those skilled in the art that various changes in the methods, products, devices, and apparatus disclosed herein may be made without departing from the scope of the disclosure or of the invention, which is defined in the appended claims. All changes which come within the meaning and range of equivalency of the claims are to be embraced within their scope.

What is claimed is:

1. A multi-functional device configured to facilitate both placement of a sock over a foot of a user and removal of a sock from a foot of a user, comprising:

a device body defined by a first wall comprising a first inner face and a first outer face, a second wall comprising a second inner face and a second outer face, and a third wall comprising a third inner face and a third outer face, the second wall being connected to and extending from the first wall at a first interface on a first lateral side of the first wall, and the third wall being connected to and extending from the first wall at a second interface on a second lateral side of the first wall, wherein the first wall, the second wall, and the third wall at least partially extend between a first end of the device body and a second end of the device body, wherein the second outer face comprises a protrusion extending outward from the second wall and the third outer face comprises a corresponding protrusion extending outward from the third wall, the protrusion and the corresponding protrusion being configured to retain respective portions of a sock for facilitating placement of the sock over a foot of a user;

a hook arranged on the device body, the hook being configured to facilitate removal of a sock from a foot of a user; and a plurality of ridges arranged on the device body.

2. The multi-functional device of claim 1, wherein the device body comprises a substantially U-shaped body.

3. The multi-functional device of claim 1, wherein the first interface comprises a first curved wall forming an arcuate transition between the first wall and the second wall, and wherein the second interface comprises a second curved wall forming an arcuate transition between the first wall and the third wall.

4. The multi-functional device of claim 1, wherein ridges of the plurality of ridges are arranged parallel to one another on the first outer face of the first wall.

5. The multi-functional device of claim 4, wherein the plurality of ridges comprises 5 or more ridges.

6. The multi-functional device of claim 4, wherein the plurality of ridges is arranged proximate to the first end of the device body.

7. The multi-functional device of claim 4, wherein the plurality of ridges and the hook are arranged on opposite ends of the device body.

8. The multi-functional device of claim 1, wherein the ridges of the plurality of ridges extend at least partially over the second outer face of the second wall and the third outer face of the third wall.

9. The multi-functional device of claim 8, wherein the ridges of the plurality of ridges on the second outer face of the second wall and the third outer face of the third wall have a different arrangement than the ridges of the plurality of ridges on the device body.

10. The multi-functional device of claim 1, wherein the hook is arranged on the second end of the device body.

11. The multi-functional device of claim 10, wherein the hook extends from the first wall.

12. The multi-functional device of claim 10, wherein at least a portion of the hook is arranged planarly offset from the first wall.

13. The multi-functional device of claim 10, wherein at least a portion of an edge of the first wall forms depressions on opposing lateral sides of the hook.

14. The multi-functional device of claim 1, wherein a second outer edge of the second wall forms a groove in the second wall and a third outer edge of the third wall forms a corresponding groove in the third wall, the groove and the corresponding groove being configured to retain respective portions of a sock for facilitating placement of the sock over a foot of a user.

15. The multi-functional device of claim 14, wherein the groove and the corresponding groove comprise substantially U-shaped grooves with non-parallel sidewalls.

16. The multi-functional device of claim 14, wherein the protrusion is arranged adjacent to the groove and the corresponding protrusion is arranged adjacent to the corresponding groove.

17. The multi-functional device of claim 1, wherein the second wall comprises a slot and the third wall comprises a corresponding slot, the slot and corresponding slot being configured to receive respective portions of a strap for facilitating placement of a sock over a foot of a user.

18. The multi-functional device of claim 1, wherein the second wall and the third wall form a taper proximate to the first end of the device body.

19. The multi-functional device of claim 1, wherein the plurality of ridges is configured to: (1) when a sock is arranged over the device body, provide frictional force between at least a portion of the sock and the device body to facilitate placement of the sock over a foot of a user, and (2) provide a grip holdable by a user to facilitate removal of a sock from a foot of a user.

20. A multi-functional device configured to facilitate both placement of a sock over a foot of a user and removal of a sock from a foot of a user, comprising:

a device body defined by a first substantially planar wall comprising a first inner face and a first outer face, a second substantially planar wall comprising a second inner face and a second outer face, and a third substantially planar wall comprising a third inner face and a third outer face, the second substantially planar wall being connected to and extending from the first substantially planar wall at a first interface on a first lateral side of the first substantially planar wall, and the third substantially planar wall being connected to and extending from the first substantially planar wall at a second interface on a second lateral side of the first substantially planar wall, wherein the first substantially planar wall, the second substantially planar wall, and the third substantially planar wall at least partially extend between a first end of the device body and a second end of the device body, the first end of the device body being configured to retain a sock to facilitate placement of the sock over a foot of a user, wherein the first interface comprises a first curved wall forming an arcuate transition between the first substantially planar wall and the second substantially planar wall, and wherein the second interface comprises a second curved wall forming an arcuate transition between the first substantially planar wall and the third substantially planar wall; and a hook arranged on the second end of the device body, the hook being configured to facilitate removal of a sock from a foot of a user.

21. A multi-functional device configured to facilitate both placement of a sock over a foot of a user and removal of a sock from a foot of a user, comprising:

a device body defined by a first wall comprising a first inner face and a first outer face, a second wall comprising a second inner face and a second outer face, and a third wall comprising a third inner face and a third outer face, the second wall being connected to and extending from the first wall at a first interface on a first lateral side of the first wall, and the third wall being connected to and extending from the first wall at a second interface on a second lateral side of the first wall, wherein the first wall, the second wall, and the third wall at least partially extend between a first end of the device body and a second end of the device body, wherein a second outer edge of the second wall and a third outer edge of the third wall form corresponding grooves configured to retain sock material surrounding an upper opening of a sock to facilitate placement of the sock over a foot of a user; and a hook arranged on the second end of the device body, the hook being configured to facilitate removal of a sock from a foot of a user.

* * * * *